US011521779B2

(12) United States Patent
Furukawa

(10) Patent No.: US 11,521,779 B2
(45) Date of Patent: Dec. 6, 2022

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Naotoshi Furukawa, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 303 days.

(21) Appl. No.: 17/016,500

(22) Filed: Sep. 10, 2020

(65) Prior Publication Data

US 2021/0082612 A1 Mar. 18, 2021

(30) Foreign Application Priority Data

Sep. 18, 2019 (JP) ..... JP2019-169819

(51) Int. Cl.

| | |
|---|---|
| ***H01F 27/02*** | (2006.01) |
| ***H01F 27/26*** | (2006.01) |
| ***H01F 37/00*** | (2006.01) |
| ***H01F 27/32*** | (2006.01) |
| ***H01F 27/30*** | (2006.01) |

(52) U.S. Cl.
CPC ..... *H01F 27/022* (2013.01); *H01F 27/266* (2013.01); *H01F 27/306* (2013.01); *H01F 27/324* (2013.01); *H01F 37/00* (2013.01)

(58) Field of Classification Search
CPC .... H01F 27/022; H01F 27/266; H01F 27/306; H01F 27/324; H01F 37/00
See application file for complete search history.

(56) References Cited

U.S. PATENT DOCUMENTS

| | | | | |
|---|---|---|---|---|
| 3,314,002 A * | 4/1967 | Wellford | G01D 5/204 327/113 |
| 4,652,975 A * | 3/1987 | Scott | H01F 27/06 361/836 |
| 10,283,255 B2 | 5/2019 | Yoshikawa | |

FOREIGN PATENT DOCUMENTS

| | | |
|---|---|---|
| CN | 105575642 B * | 6/2018 |
| JP | 2016-207701 A | 12/2016 |

* cited by examiner

*Primary Examiner* — Tuyen T Nguyen
(74) *Attorney, Agent, or Firm* — Oliff PLC

(57) ABSTRACT

A reactor including: an assembly that includes a coil and a magnetic core; a case in which the assembly is accommodated; a sealing resin with which the case is filled; and a pushing plate accommodated in the case, wherein the case includes a bottom, a side wall, and at least one groove that is open in an inner surface of the side wall, and the groove of the case includes an opening end provided in an end surface of the side wall of the case that is located opposite to the bottom of the case, and a closed end provided on the bottom of the case with respect to the opening end.

6 Claims, 8 Drawing Sheets

REACTOR

BACKGROUND

The disclosure relates to a reactor.

JP 2016-207701A discloses a reactor that includes a coil, a magnetic core, a case, a sealing resin portion, and a support portion. The assembly of the coil and the magnetic core is accommodated in the case, and the case is filled with the sealing resin portion. The support portion prevents the assembly from coming off from the case together with the sealing resin portion. The support portion is a belt-shaped flat plate material. A central portion of the support portion is arranged overlapping an outer core portion that constitutes an end portion of the assembly. Both end portions of the support portion are respectively bolt fastened to opposing corner portions of the case.

SUMMARY

There is demand for a reactor provided with a case and a sealing resin portion to be capable of inhibiting displacement of the sealing resin portion caused by vibration or the like. Also, a small reactor is desirable.

In the reactor disclosed in JP 2016-207701A, the case and the support portion are formed as a single body through bolt fastening. Thus, when the case vibrates, the support portion subjected to vibration of the case also vibrates. It is conceivable that the support portion cannot inhibit the displacement of the sealing resin portion as appropriate due to, when the sealing resin portion vibrates, the support portion and the case vibrating at frequencies that are different from that of the sealing resin portion. In particular, if the amplitude of the sealing resin portion is high due to the sealing resin portion and the assembly resonating with each other, the displacement of the sealing resin portion is likely to increase. The sealing resin portion is likely to undergo cohesive failure and separate from the case due to stress and strain resulting from large displacement. As a result, the assembly is likely to come off from the case, and the heat dissipation properties of the reactor deteriorate. Thus, there is room for improvement with regard to the structure for inhibiting the displacement of the sealing resin portion.

Also, if the case and the support portion are bolt fastened, the case needs a base for bolts. In addition, with a structure in which a plate spring is fitted between an inner wall surface of the case and an outer circumferential surface of the assembly, and the plate spring directly pushes the assembly against an inner bottom surface side of the case, a space in which the plate spring is arranged in the case is required. With these structures, the size of a case is likely to be increased. Thus, there is room for improvement with regard to a reduction in size.

An exemplary aspect of the disclosure provides a reactor capable of inhibiting displacement of a sealing resin portion caused by vibration.

A reactor according to an exemplary aspect includes an assembly that includes a coil and a magnetic core; a case in which the assembly is accommodated; a sealing resin with which the case is filled; and a pushing plate accommodated in the case, wherein the case includes a bottom, a side wall, and at least one groove that is open in an inner surface of the side wall, the groove of the case includes an opening end provided in an end surface of the side wall of the case that is located opposite to the bottom of the case, and a closed end provided on the bottom of the case with respect to the opening end, the pushing plate includes a main body and at least one attachment that extends from the main body, the main body is arranged overlapping a surface of the assembly that is located opposite to the bottom of the case, the attachment is fitted to the groove of the case, the sealing resin includes a first resin with which a portion located between the assembly and the main body is filled, and a second resin with which the groove of the case is filled.

The reactor of this disclosure is capable of inhibiting displacement of the sealing resin caused by vibration.

DETAILED DESCRIPTION OF EMBODIMENTS

Figure 1:
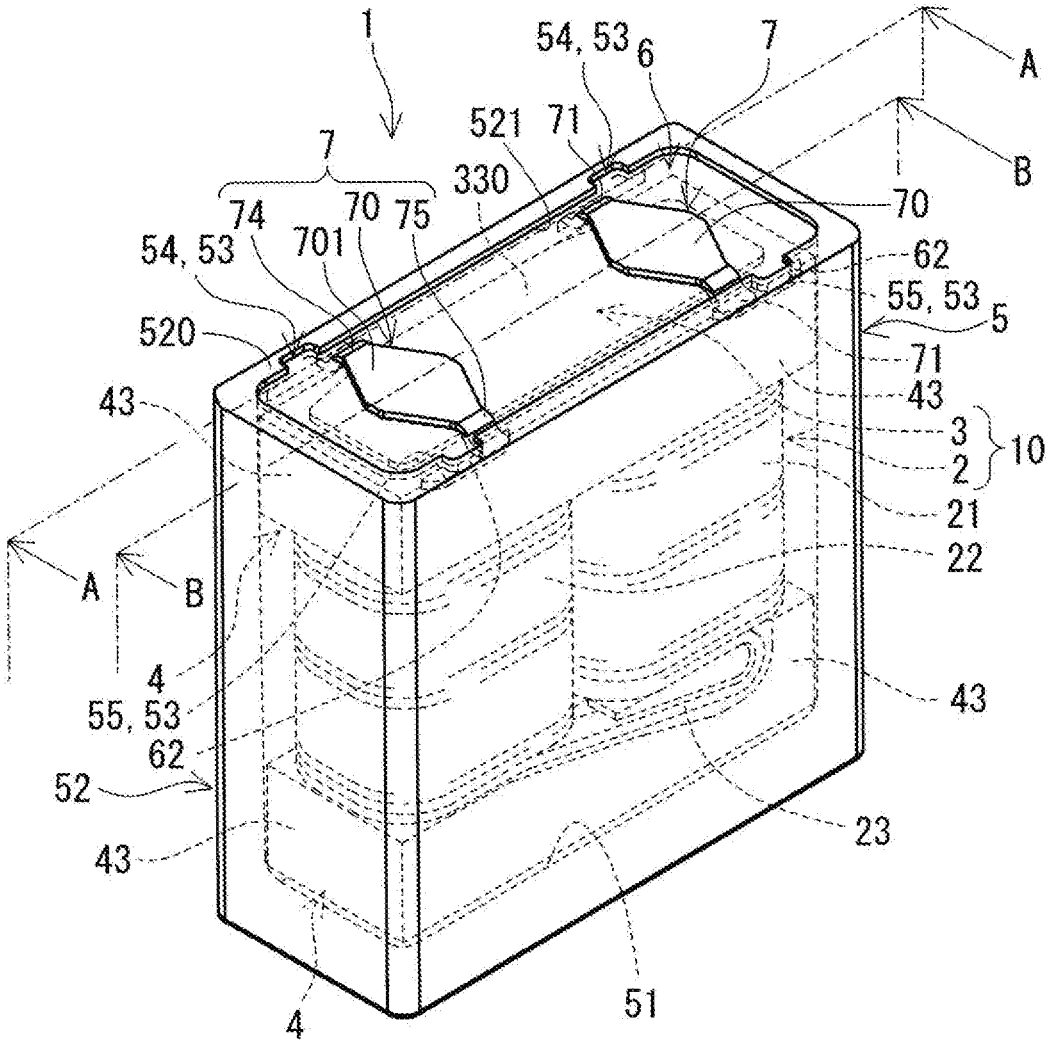
FIG. 1 is a perspective view showing a reactor of Embodiment 1.

Description of Embodiments of the Present Disclosure

First, embodiments of this disclosure will be described.

(1) A reactor according to one aspect of this disclosure includes:

an assembly that includes a coil and a magnetic core;
a case in which the assembly is accommodated;
a sealing resin portion with which the case is filled; and
a pushing member accommodated in the case,
in which the case includes
a bottom portion, a side wall portion, and at least one groove portion that is open in an inner surface of the side wall portion,
the groove portion includes
an opening end provided in an end surface of the side wall portion that is located opposite to the bottom portion, and
a closed end provided on the bottom portion side with respect to the open end,
the pushing member includes
a main body portion and at least one attachment portion that extends from the main body portion,
the main body portion is arranged overlapping a surface of the assembly that is located opposite to the bottom portion,
the attachment portion is fitted to the groove portion,
the sealing resin portion includes a first resin portion with which a portion located between the assembly and the main body portion is filled, and a second resin portion with which the groove portion is filled.

The reactor of this disclosure is capable of inhibiting displacement of the sealing resin portion caused by vibration or the like, due to a pushing member. In particular, even if the case is vibrating, the pushing member is unlikely to be affected by vibration of the case due to the following reason (A). Thus, the reactor of this disclosure can more readily inhibit displacement of the sealing resin portion. Also, the pushing member can reliably inhibit the displacement of the sealing resin portion due to the following reasons (B) and (C).

(A) Unlike a structure in which a pushing member is directly fixed to a case through bolt fastening, press fitting, a plate spring, or the like, the pushing member has a structure in which an attachment portion is fitted to a groove portion. With this structure, the contact area between the attachment portion of the pushing member and the case is smaller than that of a structure in which bolt fastening, pressure fitting, a plate spring, or the like is utilized. Thus, vibration of the case is unlikely to be transmitted to the pushing member.

(B) The pushing member is unlikely to come loose from the groove portion.

One of the reasons for this is that the groove portion is filled with the second resin portion in a state in which the attachment portion of the pushing member is fitted to the groove portion. The position of the attachment portion with respect to the groove portion is unlikely to shift due to the second resin portion.

(C) Even if the assembly is vibrating, the pushing member is unlikely to be affected by vibration of the assembly.

One of the reasons for this is that the pushing member is not in direct contact with the assembly because the first resin portion is present between the pushing member and the assembly.

Also, the reactor of this disclosure is small. One of the reasons for this is that the size of the case can be readily reduced because a bolt base for fixing the pushing member to the case and a space for arranging a plate spring between the assembly and the side wall portion of the case are not required. Another reason therefor is that, although the reactor includes the pushing member, the pushing member can be accommodated in the case.

(2) An example of a reactor of this disclosure is an embodiment in which the case includes two of the groove portions, the pushing member includes two of the attachment portions on respective sides of the main body portion, the two groove portions are respectively provided at opposing portions of the inner surface, and the two attachment portions are respectively fitted into the groove portions.

In the above-described embodiment, the pushing member is unlikely to come loose from the two groove portions, compared to a case where the number of groove portions is one.

(3) An example of a reactor of this disclosure is an embodiment in which the groove portion includes a first groove portion and a second groove portion that is continuous with the first groove portion, the first groove portion has the opening end, the second groove portion has the closed end, and an extending direction of the first groove portion and an extending direction of the second groove portion are different from each other.

In the above-described embodiment, the pushing member is unlikely to come loose from the groove portions, compared to a case where the groove portions extend in one direction.

(4) An example of the reactor according to (3) above is an embodiment in which the extending direction of the first groove portion is a depth direction of the case, and the extending direction of the second groove portion is a direction orthogonal to the depth direction.

In the above-described embodiment, the pushing member is less likely to come loose from the groove portions.

(5) An example of a reactor of this disclosure is an embodiment in which a surface of the main body portion that is located opposite to the bottom portion is exposed from the sealing resin portion.

In the above-described embodiment, the reactor is small because the height of the case can be low. Also, in the above-described embodiment, manufacturability is also high because the time for filling the case with resin that constitutes the sealing resin portion, the solidification time of the resin, and the like can be short.

(6) An example of a reactor of this disclosure is an embodiment in which a planar shape of the main body portion is a rhombus shape.

The pushing member in the above-described embodiment has higher rigidity, is smaller, and is lighter in weight, compared to a case where a belt-shaped member having a uniform width is used as will be described later. Thus, the above-described embodiment can reduce the size and weight of a reactor while inhibiting displacement of the sealing resin portion.

DETAILS OF EMBODIMENTS OF THE PRESENT DISCLOSURE

Hereinafter, specific examples of a reactor according to embodiments of this disclosure will be described with reference to the drawings. The same reference numerals in the drawings indicate objects having the same names.

Embodiment 1

A reactor of Embodiment 1 will be described with reference to FIGS. 1 to 8.

Overview

As shown in FIG. 1, a reactor 1 of Embodiment 1 includes an assembly 10 that includes a coil 2 and a magnetic core 3, a case 5, a sealing resin portion 6 (sealing resin), and pushing members 7 (pushing plate). The assembly 10 is accommodated in the case 5. The case 5 is filled with the sealing resin portion 6. Also, the pushing member 7 are accommodated in the case 5. The pushing members 7 accommodated in the case 5 are arranged overlapping the assembly 10.

Figure 6:
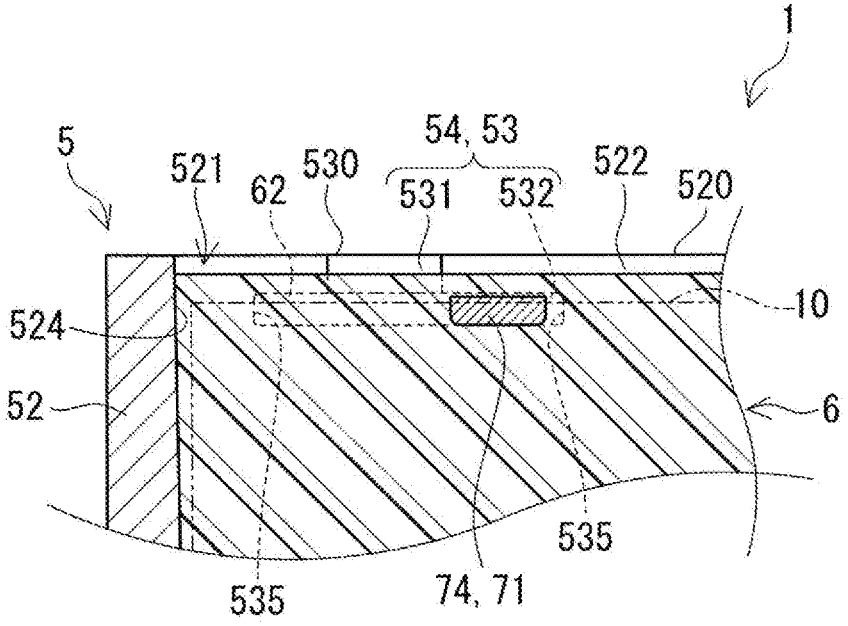
FIG. 6 is a partial cross-sectional view of the reactor of Embodiment 1 shown in FIG. 1, the cross-sectional view being obtained by cutting the reactor along a cutting line A-A.

In the reactor 1 of Embodiment 1, the pushing members 7 each include a main body portion 70 (main body) and attachment portions 71 (attachments), and inhibit displacement of the sealing resin portion 6 caused by vibration and the like. In particular, the pushing members 7 are arranged on the case 5 such that, when the case 5 is vibrating, the vibration of the case 5 is unlikely to be transmitted to the pushing members 7. This arrangement state is achieved by groove portions 53 (grooves) provided in the case 5 and the sealing resin portion 6. Briefly, the case 5 includes at least one groove portion 53 that is open in an end surface 520 and an inner surface 521 of a side wall portion 52. The attachment portions 71 of the pushing member 7 are fitted to the groove portions 53. The case 5 is filled with the sealing resin portion 6 such that the sealing resin portion 6 is in contact with both the main body portions 70 and the attachment portions 71. The sealing resin portion 6 includes a first resin portion 61 (first resin) (FIG. 7) and a second resin portion 62 (second resin). The groove portions 53 are filled with the second resin portions 62 (FIG. 6). The second resin portions 62 keeps the pushing member 7 fitted to the groove portions 53. That is, the pushing members 7 are prevented from coming loose from the groove portions 53.

The case 5 of this example includes two groove portions 54 and 55 at opposing positions of the inner surface 521. The pushing member 7 includes two attachment portions 74 and 75. The attachment portions 74 and 75 are fitted to the groove portions 54 and 55 and the groove portions 54 and 55 are filled with the second resin portions 62.

Figure 2:
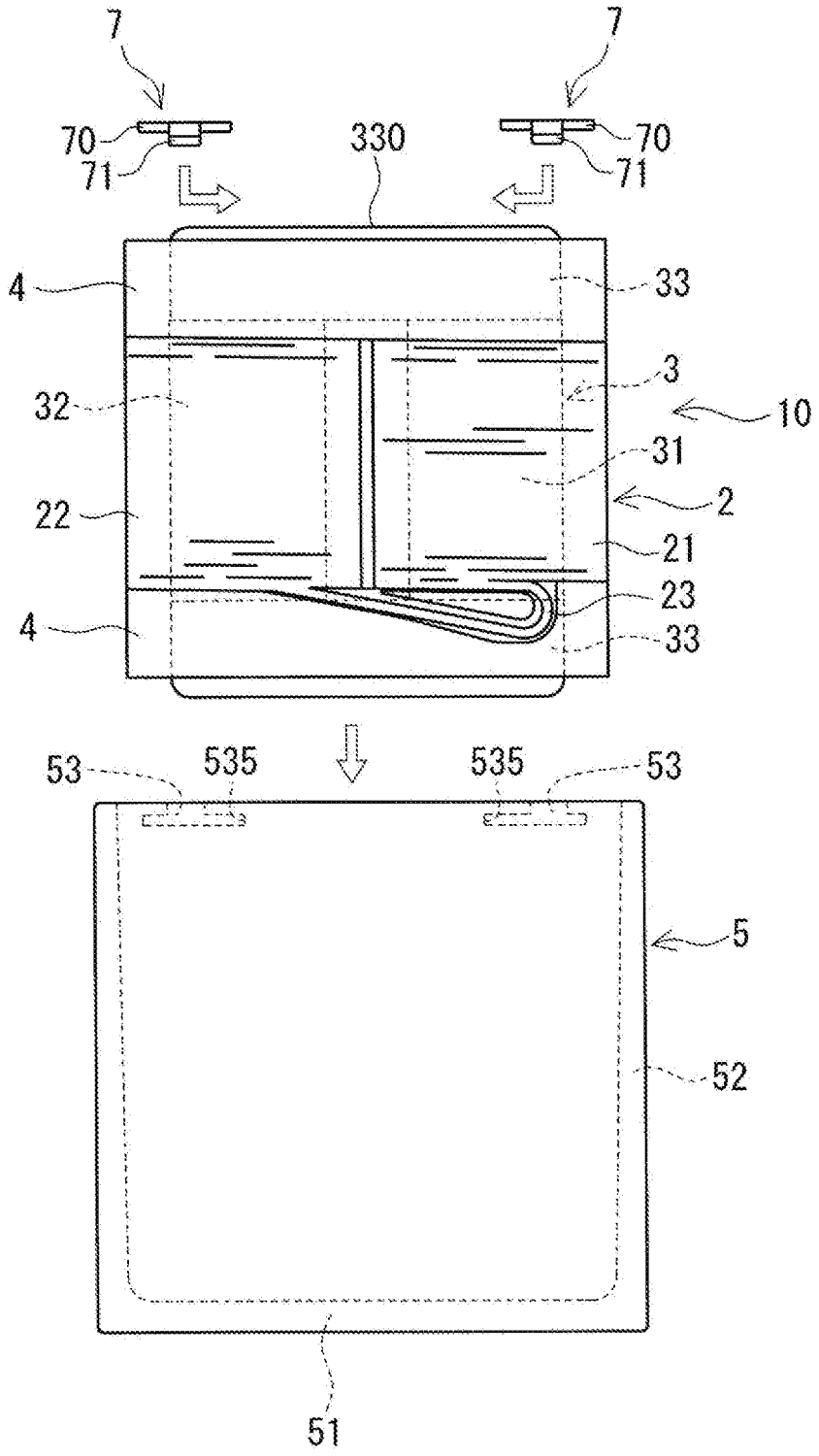
FIG. 2 is an exploded view illustrating members other than a sealing resin portion, with regard to members constituting the reactor of Embodiment 1.

The following describes the overview of the assembly 10, the case 5, and the sealing resin portion 6 in order mainly with reference to FIGS. 1 and 2. Then, the pushing member 7, the groove portions 53 in the case 5, and the sealing resin portion 6 will be described in detail in order.

Assembly

The assembly 10 includes the coil 2 and the magnetic core 3. In addition, the assembly 10 may include a member for increasing electrical insulating properties between the coil 2 and the magnetic core 3, or the like. Examples of such a member include a holding member 4, which will be described later, and a resin molded portion (not shown).

Coil

The coil 2 includes tubular winding portions obtained by helically winding a winding wire. An external device such as a power source or the like is connected to an end portion of the winding wire that is continuous with the winding portion. The winding wire, the end portions of the winding wire, and the external device are not shown.

An example of the winding wire includes a covered wire provided with a conductor wire and an insulating coating film covering the outer circumferential surface of the conductor wire. An example of a constituent material of the conductor wire is copper. An example of a constituent material of the insulating coating film is resin such as a polyamide-imide. The winding wire of this example is a coated flat wire having a rectangular cross-sectional shape.

The coil 2 of this example includes two winding portions 21 and 22, and a linking portion 23 for linking the two winding portions 21 and 22 together. The two winding portions 21 and 22 are arranged side-by-side such that the axes thereof are parallel to each other (FIG. 2). In this example, the specifications such as the shapes, the winding directions, the numbers of turns of the winding portions 21 and 22, and the sizes of the winding wires are the same. Also, the coil 2 of this example is constituted by one continuous winding wire. The linking portion 23 is constituted by a portion of the winding wire that extends across the winding portions 21 and 22.

The winding portions 21 and 22 of this example are square tubular edgewise coils. In this case, it is likely that the outer circumferential surfaces of the winding portions 21 and 22 are flat rectangular surfaces. As a result, the flat outer circumferential surfaces of the winding portions 21 and 22 and the flat inner surface 521 of the case 5 face each other. Thus, intervals between the winding portions 21 and 22 and the inner surface 521 of the case 5 can be easily adjusted.

Note that the shape, size, and the like of the coil 2 can be changed as appropriate. This respect preferably refers to Variation 4 that will be described later.

Magnetic Core

The magnetic core 3 has portions arranged in the winding portions of the coil 2 and a portion arranged outside the winding portions, and constitutes a closed magnetic path through which the magnetic flux formed by the coil 2 passes.

The magnetic core 3 of this example includes four columnar core pieces (FIG. 2). The two core pieces are respectively inner core portions 31 and 32 having portions arranged in the winding portions 21 and 22. The remaining two core pieces are outer core portions 33 constituting portions arranged outside the winding portions 21 and 22. The two outer core portions 33 hold the two inner core portions 31 and 32 arranged away from each other.

In this example, the core pieces constituting the inner core portions 31 and 32 have the same shape and the same size. Each core piece has a rectangular parallelepiped shape that substantially corresponds to the inner circumferential shape of the winding portions 21 and 22. Also, the core pieces are formed as a single object, and are not separated from each other.

In this example, the core pieces constituting the outer core portions 33 have the same shape and the same size. Although each core piece has a rectangular parallelepiped shape, there is no particular limitation on the shape of a core piece. Also, the core pieces are formed as a single object, and are not separated from each other. Also, although corner portions of the core piece are chamfered, chamfering may be omitted. The corner portions of the chamfered core piece are unlikely to be chipped, and have high strength.

An example of the core pieces constituting the magnetic core 3 is a compact that is mainly made of a soft magnetic material. The soft magnetic material may be metal or non-metal. Examples of metal include iron and iron-based alloys. Examples of the iron-based alloy include Fe—Si alloys and Fe—Ni alloys. Examples of non-metal include ferrite. Examples of the above-described compact include compacts made of a composite material, powder compacts, a member obtained by stacking plate materials made of a soft magnetic material, such as electrical steel sheets, and sintered compacts such as a ferrite core.

A compact made of a composite material contains magnetic powder and resin. Magnetic powder is dispersed in resin. Examples of the resin include thermoplastic resins and thermosetting resins. Examples of the thermoplastic resin include polyphenylene sulfide (PPS) resins, polytetrafluoroethylene (PTFE) resins, liquid crystal polymers (LCPs), polyamide (PA) resins (e.g., nylon 6 and nylon 66), polybutylene terephthalate (PBT) resins, and acrylonitrile•butadiene•styrene (ABS) resins. Examples of the thermosetting resin include unsaturated polyester resins, epoxy resins, urethane resins, and silicone resins. Typically, examples of the compact made of a composite material include compacts formed through injection molding or the like.

A powder compact is an aggregate of magnetic powder. Typically, examples of the powder compact include powder compacts obtained by subjecting powder mixture that contains magnetic powder and a binder to compression molding, and performing heat treatment on the resulting mixture.

Examples of powder particles constituting the above-described magnetic powder include magnetic particles made of a soft magnetic material, and coated particles in which an insulating coating film is provided on an outer circumferential surface of magnetic particles.

If the magnetic core 3 includes a plurality of core pieces, the constituent materials of all the core pieces may be the same, or the constituent material of at least one core piece may be different from those of the other core pieces. As in this example, the magnetic core 3 may include a core piece constituted by a compact made of a composite material, and a core piece made of a powder compact, for example. Alternatively, all of the core pieces may be compacts made of a composite material, and the types of soft magnetic materials of the core pieces and the contents of magnetic powders may be different from each other, for example.

In addition, although the magnetic core 3 shown in FIG. 2 does not have a magnetic gap between core pieces, the magnetic core 3 may have a magnetic gap. A magnetic gap may be an air gap or be formed by a plate material made of a nonmagnetic material such as alumina, for example. The magnetic core 3 that does not have a magnetic gap is easier to make small.

Note that the shape, size, and the number of core pieces of the magnetic core 3, and the like can be changed as appropriate. This respect preferably refers to Variation 5 that will be described later.

Holding Member

The reactor 1 may include holding members 4 arranged between the coil 2 and the magnetic core 3. The holding members 4 in this example support the winding portions 21 and 22, the inner core portions 31 and 32, and the outer core portions 33, and positions the inner core portions 31 and 32 and the outer core portions 33 with respect to the winding portions 21 and 22. FIGS. 1 and 2 show the overview of the holding members 4, and a detailed illustration is omitted.

The holding members 4 in this example are frame-shaped members arranged at end portions of the winding portions 21 and 22. Each holding member 4 includes a frame plate provided with a pair of through-holes, and a circumferential wall 43 provided along a circumferential edge of the frame plate. The holding members 4 have the same basic configuration.

The frame plate of the holding member 4 is arranged between end surfaces of the winding portions 21 and 22 and the inner end surface of the outer core portion 33. End portions of the inner core portions 31 and 32 are respectively inserted into through-holes provided in the frame plate. Also, the frame plate is provided with a protruding piece. The protruding piece protrudes from the inner circumferential edges of the through-holes formed in a surface of the frame plate located on the winding portions 21 and 22 side in the axial direction of the inner core portions 31 and 32. Also, the protruding pieces are inserted between the inner circumferential surfaces of the winding portions 21 and 22 and the outer circumferential surfaces of the inner core portions 31 and 32. The winding portions 21 and 22 and the inner core portions 31 and 32 are separated from each other by the protruding pieces, and thus electrical insulating properties therebetween are improved. Also, the winding portions 21 and 22 and the inner core portions 31 and 32 are positioned by the protruding pieces.

The circumferential walls 43 of the holding members 4 surround the outer circumferential surfaces of the outer core portions 33, and position the outer core portions 33 with respect to the holding members 4. The circumferential walls 43 in this example each have a rectangular frame shape that continuously covers the outer circumferential surface of the outer core portion 33, that is, a surface thereof that faces the inner surface 521 of the side wall portion 52 of the case 5.

The shape, size, and the like of the holding member 4 can be changed as appropriate. A known configuration may be utilized for the holding member 4.

An example of the constituent material of the holding member 4 is an electrical insulating material such as resin. Examples thereof include thermoplastic resins and thermosetting resins. Specific examples of the thermoplastic resin and the thermosetting resin preferably refer to the description of a compact made of a composite material in Section "Magnetic core". The holding member 4 can be manufactured through known molding such as injection molding or the like.

Resin Molded Portion

The reactor 1 may include a resin molded portion covering at least a portion of the magnetic core 3. The resin molded portion improves electrical insulating properties between the coil 2 or peripheral components of the reactor 1 and the magnetic core 3, protects the magnetic core 3 from an external environment, and also mechanically protects the magnetic core 3, for example.

The resin molded portion has good heat dissipation properties when the resin molded portion covers the magnetic core 3, and does not cover the outer circumferential surfaces of the winding portions 21 and 22 to expose the outer circumferential surfaces thereof. The reason for this is that the outer circumferential surfaces of the winding portions 21 and 22 can be close to the inner surface 521 of the case 5.

A covering range, the thickness, and the like of the resin molded portion can be selected as appropriate.

The resin molded portion may include an inner resin portion that covers at least a portion of the inner core portions 31 and 32, and an outer resin portion that covers at least a portion of the outer core portions 33, for example. In this case, if a resin molded portion is an integrally molded article in which the inner resin portion and the outer resin portion are continuous with each other, the resin molded portion can hold a plurality of core pieces as a single body. Thus, the resin molded portion can increase the strength and rigidity of the magnetic core 3 as a single body. Such a resin molded portion may be manufactured as follows, for example. The size of the circumferential walls 43 is adjusted such that gaps are provided between the inner circumferential surfaces of the circumferential walls 43 of the above-described holding members 4 and the outer circumferential surfaces of the outer core portions 33. A space for connecting these gaps, the through-holes of the holding members 4, and gaps between the winding portions 21 and 22 and the inner core portions 31 and 32 is filled with resin that is a raw material of the resin molded portion, and the resin is solidified.

Alternatively, a configuration may be adopted in which the resin molded portion does not include an inner resin portion, and substantially covers only the outer core portions 33, for example.

Examples of the constituent material of the resin molded portion include various resins. Examples thereof include thermoplastic resins. Specific examples of the thermoplastic resin preferably refer to the description of a compact made of a composite material in Section "Magnetic core". In addition to resin, the constituent material may include powder made of a non-metallic and inorganic material that will be described in Section "Sealing resin portion". A resin molded portion that contains this powder has good heat dissipation properties. The resin molded portion can be formed through known molding such as injection molding or the like.

Note that the reactor 1 need not include one or both of the resin molded portion and the above-described holding members 4.

Case

The case 5 accommodates substantially the entire assembly 10, and protects the assembly 10 from an external environment, and mechanically protects the assembly 10, for example. The case 5 in this example is made of metal, and also functions as a heat dissipation path of the assembly 10.

The case 5 includes a bottom portion 51 (bottom) and a side wall portion 52 (side wall). The bottom portion 51 is a flat plate-shaped member. The side wall portion 52 is frame-shaped member that extends upward from the circumferential edge of the bottom portion 51 and is continuous with the circumferential edge. The case 5 is a tubular member that has a bottom and is open on a side that is located opposite to the bottom portion 51, that is, the upper side in FIG. 1. The bottom portion 51 and the side wall portion 52 constitute an internal space having a shape and a size to be capable of accommodating the assembly 10.

Figure 4:
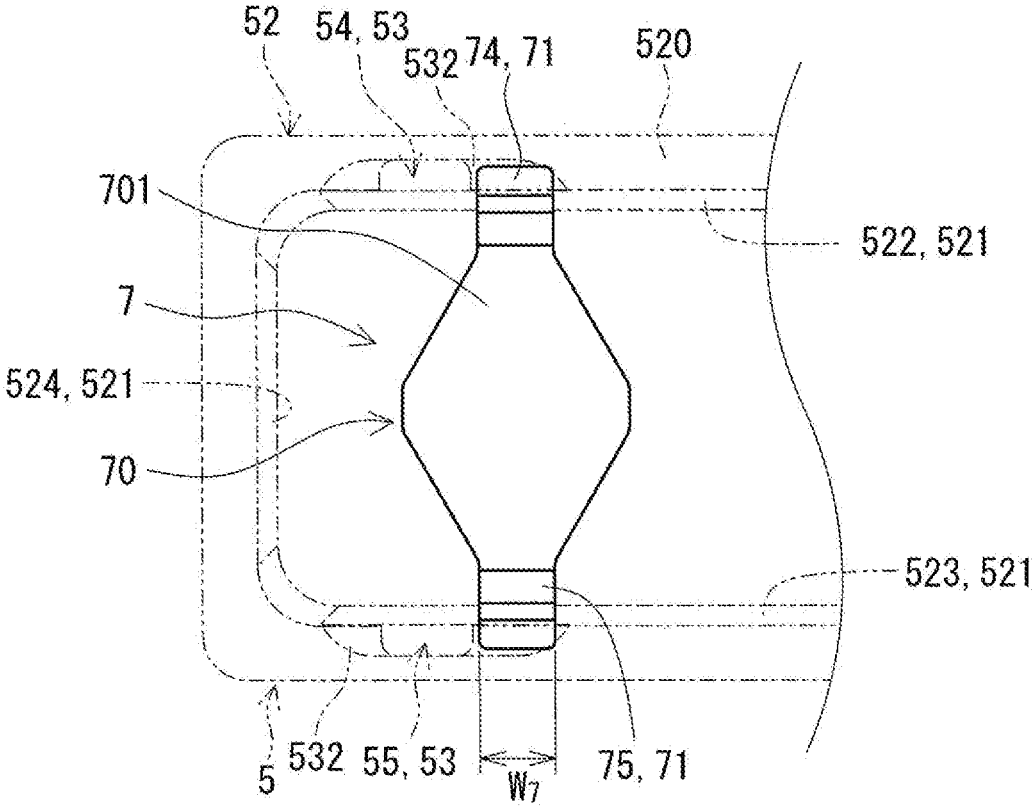
FIG. 4 is a plan view showing the pushing member provided in the reactor of Embodiment 1.
Figure 5:
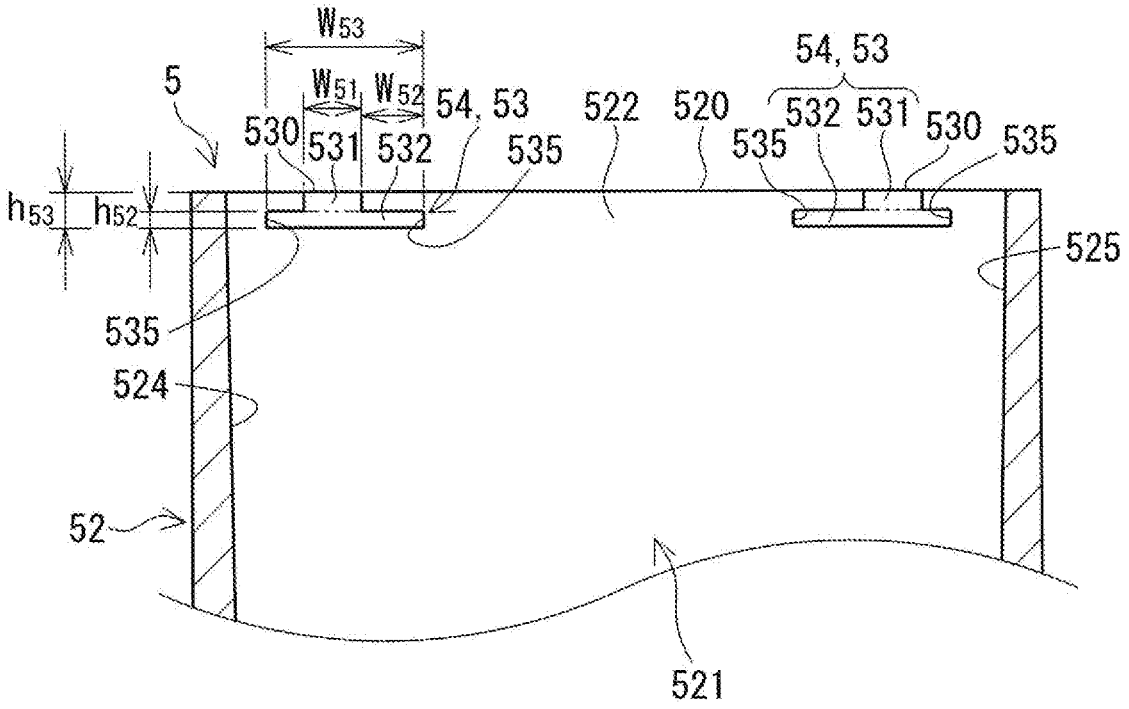
FIG. 5 is a partial cross-sectional view of a case provided in the reactor shown in FIG. 1, the cross-sectional view being obtained by cutting the case along a cutting line A-A.

The case 5 in this example is a rectangular parallelepiped container. The bottom portion 51 and the opening portion have a rectangular shape in plan view in the depth direction of the case 5. The side wall portion 52 has a rectangular tubular shape. The inner surface 521 of the side wall portion 52 has opposing inner surfaces 522 and 523, and opposing inner surfaces 524 and 525 (FIGS. 4 and 5). Here, the inner surfaces 522 and 523 are located on both sides in the short-side direction of the above-described rectangle (FIG. 4). The inner surfaces 524 and 525 are located on both sides in the long-side direction of the rectangle (FIG. 5). The length of the inner surfaces 522 and 523 corresponds to the length of a long side of the rectangle. The length of the inner surfaces 524 and 525 corresponds to the length of a short side of the rectangle.

In this example, the inner bottom surface of the bottom portion 51 and the inner surfaces 522 to 525 of the side wall portion 52 are flat surfaces. The flat outer circumferential surface of the winding portions 21 and 22 and the flat inner surfaces 522 to 525 face each other in a state in which the assembly 10 is accommodated in the case 5. The distance between the outer circumferential surface of the winding portions 21 and 22 and the inner surfaces 522 to 525 of the case 5 corresponds to the thickness of the sealing resin portion 6. The size of the case 5 is adjusted in accordance with the size of the assembly 10 such that the thickness of the sealing resin portion 6 reaches a predetermined thickness.

The case 5 in this example is a metal box in which the bottom portion 51 and the side wall portion 52 are formed as a single body. In particular, when metal that constitutes the case 5 is an aluminum-based material as in this example, the case 5 has effects such as being good heat dissipation properties, being light in weight, and being unlikely to exert magnetic influence on the coil 2 due to the aluminum-based material being a nonmagnetic material. An aluminum-based material is pure aluminum or an aluminum-based alloy.

In this example, the axial direction of the winding portions 21 and 22 is parallel to the depth direction of the case 5 in a state in which the assembly 10 is accommodated in the case 5. In this case, out of the two outer core portions 33, an end surface of one of the outer core portions 33 is arranged on the opening side of the case 5. This end surface is a surface of the assembly 10 that is located opposite to the bottom portion 51, and is referred to as an upper end surface 330 hereinafter. An end surface of the other outer core portion 33 is a surface that is arranged on the bottom portion 51 side of the case 5 and faces the inner bottom surface of the case 5.

Note that a state in which the assembly 10 is accommodated in the case 5 can be changed as appropriate. This respect preferably refers to Variation 3 that will be described later.

Sealing Resin Portion

The sealing resin portion 6 covers substantially the entire assembly 10 accommodated in the case 5. More specifically, a gap between the outer circumferential surface of the assembly 10 and the inner surface 521 of the case 5 is filled with the sealing resin portion 6. Also, the sealing resin portion 6 covers a surface of the assembly 10 that is located opposite to the bottom portion 51, here, the upper end surface 330 of the outer core portion 33. As a result, the entire assembly 10 is substantially embedded in the sealing resin portion 6. Such a sealing resin portion 6 functions to protect the assembly 10 from an external environment, mechanically protect the assembly 10, improve electrical insulating properties between the assembly 10 and the case 5, hold the assembly 10 and the case 5 as a single body, and improve heat dissipation properties, for example.

It is preferable to adjust the thickness of the sealing resin portion 6 to quantitatively satisfy the following conditions.

- Interface stress between the sealing resin portion 6 and the case 5 is absorbed due to the sealing resin portion 6 undergoing elastic deformation.
- The sealing resin portion 6 is unlikely to undergo cohesive failure or shear through stress and strain caused by vibration of the sealing resin portion 6.

The smaller the thickness of the sealing resin portion 6 surrounding the outer circumferential surface of the assembly 10 is, the better the heat dissipation properties of the reactor 1 are, and the larger the thickness thereof is, the more readily the assembly 10 can be kept fixed into the case 5 in a range satisfying the above-described conditions.

Also, the sealing resin portion 6 is in contact with the pushing members 7. Also, the sealing resin portion 6 maintains a state in which the pushing members 7 are arranged at predetermined positions of the case 5. This point will be described later.

Examples of the constituent material of the sealing resin portion 6 include various resins. Examples thereof include thermosetting resins. Examples of the thermosetting resin include silicone resins, epoxy resins, urethane resins, and unsaturated polyester resins. The sealing resin portion 6 that mainly contains a silicone resin has good heat resistance and heat dissipation properties. Note that a silicone resin may be in gel form. The sealing resin portion 6 that mainly contains an epoxy resin has high elastic modulus, and can firmly fix the assembly 10 to the case 5. Examples of the other resins include thermoplastic resins such as PPS resins.

In addition to the above-described resins, the constituent material of the sealing resin portion 6 may contain powder made of a non-metallic and inorganic material with high heat conductivity. Examples of such a non-metallic and inorganic material include ceramic materials and carbon-based materials. Examples of the ceramic materials include alumina and silica. The sealing resin portion 6 containing powder made of a non-metallic and inorganic material having high heat conductivity has good heat dissipation properties. The sealing resin portion 6 containing powder made of a ceramic material also has good electrical insulating properties. A known resin composition may be utilized as a constituent material of the sealing resin portion 6.

Pushing Member

Figure 3:
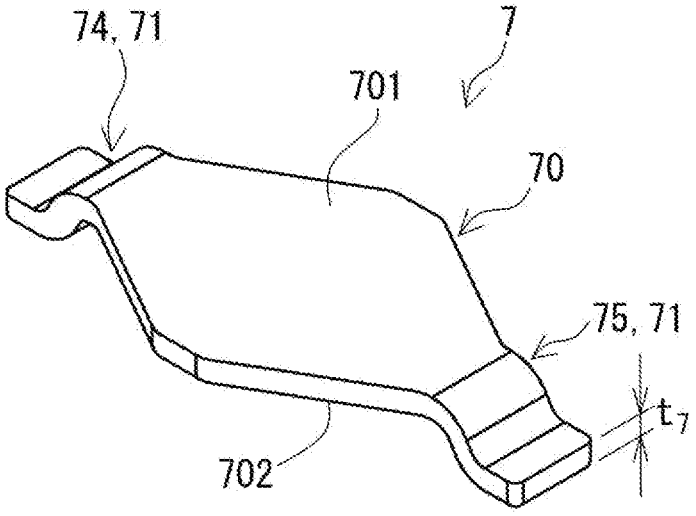
FIG. 3 is a perspective view showing a pushing member provided in the reactor of Embodiment 1.

Hereinafter, the pushing member 7 will be described with mainly referring to FIGS. 3 and 4.

Overview

The pushing member 7 includes a main body portion 70 and at least one attachment portion 71 that extends from the main body portion 70. The pushing member 7 is arranged in contact with the sealing resin portion 6 (see FIGS. 6 and 7 that will be described later), and inhibits displacement of the sealing resin portion 6 mainly in the depth direction of the case 5. However, the pushing member 7 is fitted to the case 5 with play as a result of the attachment portions 71 being fitted to the groove portions 53 of the case 5, instead of being fixed to the case 5 through bolt fastening, pressure fitting, or the like (FIG. 6). Also, a portion of the attachment portion 71 that is not in contact with the inner circumferential surface that constitutes a groove portion 53 is covered by the sealing resin portion 6 (FIG. 6). As a result, a state in which the pushing member 7 is fitted to the groove portion 53, that is, a state in which the pushing member 7 is accommodated in the case 5 is maintained for a long period of time. Thus, the pushing member 7 is a member independent of the case 5, whereas displacement of the sealing resin portion 6 in the depth direction of the case 5 is inhibited.

Figure 7:
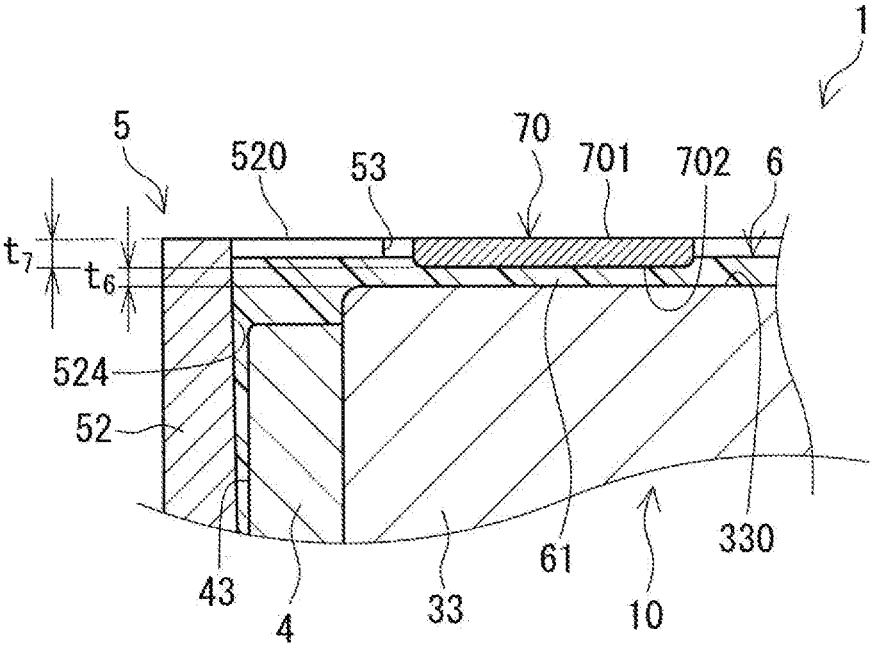
FIG. 7 is a partial cross-sectional view of the reactor of Embodiment 1 shown in FIG. 1, the cross-sectional view being obtained by cutting the reactor along a cutting line B-B.

The pushing member 7 in this example includes two attachment portions 74 and 75 on respective sides of the main body portion 70. The two attachment portions 74 and 75 are respectively fitted to the groove portions 54 and 55 of the case 5 (FIG. 4). The main body portion 70 is arranged overlapping the upper end surface 330 of the outer core portion 33 of the assembly 10 (FIGS. 1 and 7).

Main Body Portion

The main body portion 70 in this example has a flat plate shape. A surface of the main body portion 70 that is located opposite to the bottom portion 51 of the case 5, here, a front surface 701, is arranged facing the opening side of the case 5 in a state in which the pushing member 7 is arranged in the case 5 (FIG. 4). A back surface 702 that is located opposite to the front surface 701 is arranged facing the inner bottom surface of the bottom portion 51 of the case 5 (FIG. 7). The back surface 702 is arranged in contact with the sealing resin portion 6 (FIG. 7).

There is no particular limitation on the shape of the main body portion 70 as long as the main body portion 70 can directly push the sealing resin portion 6 when the sealing resin portion 6 vibrates. The pushing member 7 may be a belt-shaped member in which the main body portion 70 and the attachment portion 71 have the same width. In this case, the planar shape of the main body portion 70 is a rectangular shape.

In particular, for the purpose of inhibiting displacement of the sealing resin portion 6, it is preferable that the main body portion 70 has high rigidity, that is, the main body portion 70 is a rigid body instead of a spring material. In this example, the planar shape of the main body portion 70 is a rhombus shape. Also, the length of the main body portion 70 in a short-axis direction of the rhombus is larger than the width of the attachment portion 71. The width of the attachment portion 71 here refers to the length thereof in a direction orthogonal to the long-axis direction of the rhombus. The long-axis direction corresponds to the longitudinal direction of the pushing member 7, that is, the up-down direction on a paper plane in FIG. 4.

The rhombic main body portion 70 has portions protruding from the attachment portions 71 in a direction orthogonal to the longitudinal direction of the pushing member 7. The pushing member 7 provided with such a main body portion 70 has higher rigidity, compared to a case where the pushing member 7 has a belt shape whose width is the same as the width of the attachment portion 71. Also, the pushing member 7 has the same degree of rigidity, is smaller, and is lighter in weight because the plane area thereof is smaller, compared to a case where the pushing member 7 has a belt shape having a width that is the same as the length of a short axis of the rhombus. Thus, the pushing member 7 in this example is small and light in weight while favorably inhibiting vibration of the sealing resin portion 6. Note that the planar shape of the pushing member 7 refers to a shape viewed in plan view in the thickness direction of the pushing member 7. The above-described thickness direction corresponds to a direction perpendicular to a paper plane in FIG. 4.

Specific examples of the planar shape of the main body portion 70 other than rectangular and rhombus shapes include polygons and ellipses. In particular, it is preferable that the planar shape of the main body portion 70 is a rectangular shape in which one of the length and the width thereof is longer than the other as in this example.

Attachment Portion

The attachment portions 74 and 75 in this example are located at end portions of the main body portion 70 in the long-axis direction. Also, the pushing member 7 in this example is not a flat plate material in which the main body portion 70 and the attachment portions 74 and 75 are arranged on the same plane, and the attachment portions 74 and 75 are displaced with respect to the main body portion 70 in the thickness direction (FIG. 3). Specifically, in a state in which the pushing member 7 is arranged in the case 5, the main body portion 70 is located on the opening side of the case 5, and the attachment portions 74 and 75 are located on the bottom portion 51 side of the case 5 with respect to the main body portion 70 (FIG. 1). The attachment portions 74 and 75 include legs and engaging portions to realize such an arrangement. The legs extend in a direction intersecting with a direction extending along the front surface 701 of the main body portion 70. The lengths of the legs are adjusted such that the position of the main body portion 70 in the depth direction of the case 5 reaches a predetermined position. The engaging portions are continuous with the legs, and are provided in parallel to the direction extending along the front surface 701. The engaging portions are fitted to the groove portions 54 and 55.

Size

It is preferable that the size of the main body portion 70, here, the short-axis length, the long-axis length, the plane area, and the like of the rhombus are adjusted in accordance with the size of the opening portion of the case 5, the thickness of the sealing resin portion 6, in particular, a thickness $t_6$ (FIG. 7) and the like of the first resin portion 61, which will be described later. In this example, the pushing member 7 is arranged in the case 5 such that the long-axis direction of the main body portion 70 extends in the short-side direction of the case 5 (FIG. 4). Thus, the long-axis length of the main body portion 70 is smaller than the short-side length of the case 5. In this respect, the pushing member 7 is small. Note that the short-side length of the case 5 refers to the distance between the inner surfaces 522 and 523.

It is preferable to adjust the sizes of the attachment portions 74 and 75, here, a thickness $t_7$, a width $W_7$, and the like such that the attachment portions 74 and 75 can be fitted to the groove portions 53 of the case 5.

Although the thickness $t_7$ depends on the constituent material of the pushing member 7, the thickness $t_7$ is in a range of 0.8 mm to 2.0 mm inclusive, for example. When the thickness $t_7$ is in the above-described range, the pushing member 7 is thin and light in weight.

The width $W_7$ refers to the length of the attachment portions 74 and 75 in a direction orthogonal to the long-axis direction of the main body portion 70, that is, the length in the short-axis direction. In this example, the width $W_7$ of the attachment portions 74 and 75 is smaller than the short-axis length of the rhombus of the main body portion 70.

The relationship between the size of the attachment portions 74 and 75 and the size of the groove portion 53 will be described in the section (Groove portion of case) described below.

Constituent Material

A constituent material of the pushing member 7 preferably has high rigidity. An example of the constituent material is metal. In particular, iron-based alloys such as stainless steel, aluminum-based alloys, and the like are preferable because these alloys have high rigidity. Non-magnetic iron-based alloys are preferable. The pushing member 7 made of metal may be manufactured through plastic forming such as forging, for example. Forged products have highly accurate three-dimensional shapes.

Note that the shape, size, and the like of the pushing member 7 can be changed as appropriate. Although the pushing member 7 in this example has a symmetrical shape around the short axis and the long axis of the rhombus, the pushing member 7 may have an asymmetrical shape. Alternatively, the planar shape of the main body portion 70 may be a rectangular shape other than a rhombus shape, or the like. Alternatively, the pushing member 7 may be a flat plate material in which the main body portion 70 and the attachment portions 71 are arranged on the same plane.

Groove Portions of Case

Hereinafter, the groove portions 53 of the case 5 will be described with mainly referring to FIGS. 4 to 6.

FIG. 4 virtually shows a region of the case 5 on one end side in the long-side direction, with use of line-double dashed lines. Also, FIG. 4 is a plan view of the case 5 viewed in the depth direction from the opening side of the case 5.

FIGS. 5 and 6 are cross-sectional views of the reactor 1 obtained by cutting the reactor 1 along a plane parallel to the depth direction of the case 5, that is, a cutting line A-A shown in FIG. 1, the FIGS. 5 and 6 showing partial cross-sectional views showing only a region located near the groove portions 53. FIG. 5 shows only the case 5. FIG. 6 shows only the vicinity of one groove portion 54.

The cutting line A-A cuts the reactor 1 at a position closer to the inner surface 522 than the center of the case 5 in the short-side direction.

Overview

The side wall portion 52 of the case 5 is provided with the groove portions 53. The groove portions 53 are open in the inner surface 521 of the side wall portion 52, and on a side of the side wall portion 52 that is located opposite to the bottom portion 51, that is, in the end surface 520 located on the upper side in FIGS. 5 and 6 (see also FIG. 8 that will be described later). The groove portion 53 has an opening end 530 provided in the end surface 520, and a closed end 535 provided on the bottom portion 51 side with respect to the opening end 530, that is, on the lower side in FIGS. 5 and 6. The attachment portion 71 of the pushing member 7 is inserted into the groove portion 53 from the opening end 530 (FIG. 8), and the attachment portion 71 is arranged on the closed end 535 side (FIG. 6). A gap between the inner circumferential surface constituting the groove portion 53 and the outer circumferential surface of the attachment portion 71 is filled with a portion of the sealing resin portion 6, here, a second resin portion 62 (FIG. 6). The groove portion 53 supports the pushing member 7 together with the second resin portion 62.

Number

The number of groove portions 53 provided in the case 5 need only be one or more. The case 5 in this example includes two groove portions 54 and 55 for one pushing member 7. The case 5 includes two groups of groove portions 54 and 55, and includes four groove portions 53 in total (FIG. 1). The two groove portions 54 and 55 are respectively provided in opposing portions of the inner surface 521 (FIG. 4). Here, out of the two opposing inner surfaces 522 and 523, one inner surface 522 is provided with the groove portion 54, and the other inner surface 523 is provided with the groove portion 55. Also, the case 5 in this example includes the groove portions 54 on both sides of the inner surface 522 in the long-side direction (FIG. 5), and the groove portions 55 on both sides of the inner surface 523 in the long-side direction. The above-described long-side direction corresponds to the right-left direction on a paper plane in FIG. 5. The two attachment portions 74 and 75 of one pushing member 7 are respectively fitted to the groove portions 54 and 55 in one group (FIG. 1). That is, the case 5 includes two supporting portions at opposing positions for one pushing member 7.

Shape

The groove portions 54 and 55 in this example have the same shape and the same size. Thus, the groove portions 54 and 55 will be collectively referred to as a groove portion 53 hereinafter.

The groove portion 53 in this example is constituted by a plurality of grooves having different extending directions. Specifically, the groove portion 53 includes a first groove portion 531 and a second groove portion 532 that is continuous with the first groove portion 531. The first groove portion 531 is a groove having an opening end 530. The second groove portion 532 is a groove having a closed end 535. The extending direction of the first groove portion 531 is different from the extending direction of the second groove portion 532. In this example, the extending direction of the first groove portion 531 refers to the depth direction of the case 5. The extending direction of the second groove portion 532 refers to a direction orthogonal to the above-described depth direction. In FIGS. 5 and 6, the above-described depth direction indicates the up-down direction on a paper plane, and the direction orthogonal to the depth direction indicates the right-left direction on a paper plane, that is, the long-side direction of the case 5.

FIGS. 5 and 6 virtually show the boundary between the first groove portion 531 and the second groove portion 532 with use of double dashed lines. The first groove portion 531 and the second groove portion 532 in this example are linear grooves that are provided in the inner surface 521 and whose opening edges are rectangles as shown in FIGS. 5 and 6. Also, the groove 53 in this example is a T-shaped groove.

Position

It is preferable to adjust the arrangement position of the opening end 530 of the groove portion 53 and the arrangement position of the closed end 535 with respect to the case 5 in accordance with the arrangement position of the pushing member 7. In particular, the arrangement position of the groove portion 53 may be adjusted such that the pushing member 7 is arranged at a position at which displacement of the sealing resin portion 6 can be inhibited, for example. In this example, if the reactor 1 is cut along a plane that passes through a bisector of a short side of the case 5 and extends in the long-side direction, the maximum amplitude of the first resin portion 61 in the sealing resin portion 6 that covers the opening side of the assembly 10 is located at the center in the long-side direction and the vicinity thereof. The groove portions 53 are provided such that the main body portions 70 of the pushing members 7 are arranged on both sides of the position with this maximum amplitude. In particular, the groove portions 53 are provided such that a region of the main body portion 70 that has high rigidity, that is, an intersection point of a short axis and a long axis of the rhombus and the vicinity thereof pass through the above-described bisector of the short side, and are arranged on a straight line extending in the long-side direction. Also, the case 5 in this example includes the groove portions 53 to have a line-symmetrical shape around the bisector of the long side. Note that the amplitude of the sealing resin portion 6 and the amount of displacement thereof can be obtained by analyzing a vibration state with use of commercially available simulation software or the like, for example.

The groove portion 53 may be formed at a predetermined position of the inner surface 521 of the case 5 through machining such as a cutting process, for example.

Size

The size of the groove portion 53, for example, lengths $W_{51}$, $W_{52}$, and $W_{53}$, and heights $h_{53}$ and $h_{52}$ shown in FIG. 5 are adjusted in accordance with the width $W_7$ (FIG. 4) and the thickness $t_7$ (FIG. 3) of the attachment portion 71 of the pushing member 7. In particular, the size of the groove portion 53 is adjusted such that the attachment portion 71 is fitted to the second groove portion 532 with play.

The length $W_{53}$ is the maximum length of the groove portion 53 in the long-side direction of the case 5. Here, the length $W_{53}$ is the maximum length of the second groove portion 532.

The length $W_{51}$ is a length of the opening end 530 in the long-side direction of the case 5.

The length $W_{52}$ is a length of the second groove portion 532 extending from a virtual line obtained by extending the circumferential edge of the first groove portion 531 in the depth direction of the case 5 to one closed end 535, and the length $W_{52}$ is the length of the second groove portion 532 extending in the long-side direction. One closed end 535 indicates a closed end 535 located on a side closer to the bisector of the above-described long side, that is, the closed end 535 located on the right side in FIG. 6. A length thereof from the above-described virtual line to the other closed end 535, that is, the length extending in the above-described long-side direction $(W_{53}-(W_{51}+W_{52}))$ is shorter than the length $W_{52}$.

The height $h_{53}$ is the maximum length of the groove portion 53 in the depth direction of the case 5. Here, the height $h_{53}$ is the total length of the length of the first groove portion 531 extending in the above-described depth direction and the height $h_{52}$ of the second groove portion 532.

The height $h_{52}$ is the length of the groove portion 53 extending in the depth direction of the case 5.

Figure 8:
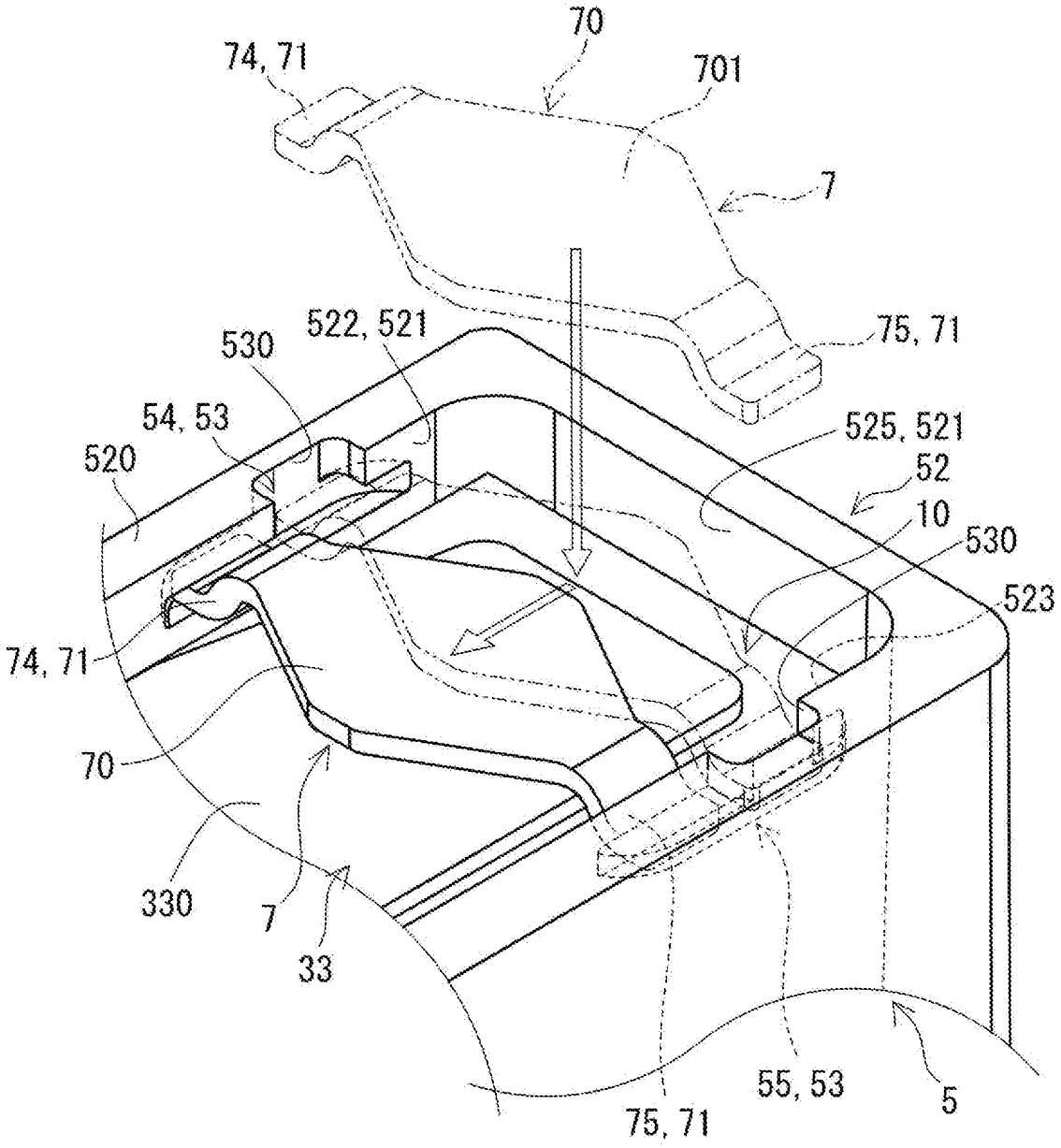
FIG. 8 is a diagram illustrating a procedure for attaching the pushing member provided in the reactor of Embodiment 1 to the case.

In this example, the length $W_{51}$ of the opening end 530 is a value obtained by adding a predetermined likelihood to the width $W_7$ of the attachment portion 71 of the pushing member 7. If $W_7<W_{51}$ holds true, it is possible to easily insert the pushing member 7 into the opening end 530 in a manufacturing process (FIG. 8).

The length $W_{52}$ of the second groove portion 532 is a value obtained by adding a predetermined likelihood to the width $W_7$ of the attachment portion 71 of the pushing member 7. If $W_7<W_{52}$ holds true, a gap is present in the surrounding portion of the attachment portion 71 in the second groove portion 532 to which the attachment portion 71 is fitted (FIG. 6). FIG. 6 illustrates a case where gaps are present on both sides of the attachment portion 71 between the closed end 535 on the right side of the second groove portion 532 and the above-described virtual line. The gaps are filled with the second resin portion 62. If $W_7<W_{52}$ holds true, the amount of the second resin portion 62 with which the second groove portion 532 is filled is high. Such a groove portion 53 and the sealing resin portion 6 favorably maintain a state in which the pushing member 7 is arranged at a predetermined position of the case 5. Also, if $W_7<W_{52}$ holds true, a surface of the inner circumferential surface that constitutes the second groove portion 532 that is located opposite to the bottom portion 51 and the entire surface of the attachment portion 71 that is located opposite to the bottom portion 51 are arranged to overlap each other. Thus, the pushing member 7 is unlikely to come loose from the second groove portion 532. Note that a surface of the above-described attachment portion 71 located on the bottom portion 51 side is a lower surface in FIG. 6.

The height $h_{52}$ of the second groove portion 532 is a value obtained by adding a predetermined likelihood to the thickness $t_7$ of the attachment portion 71 of the pushing member 7. If $t_7<h_{52}$ holds true, in the second groove portion 532 to which the attachment portion 71 is fitted, a gap is present between a surface of the inner circumferential surface constituting the second groove portion 532 that is located opposite to the bottom portion 51 and a surface of the attachment portion 71 that is located opposite to the bottom portion 51 (FIG. 6). The gap is filled with the second resin portion 62. If $t_7<t52$ holds true, the amount of the second resin portion 62 with which the second groove portion 532 is filled is large. Such a groove portion 53 and the sealing resin portion 6 favorably maintain a state in which the pushing member 7 is arranged at a predetermined position in the case 5. Note that the surface that is located opposite to the bottom portion 51 is an upper surface in FIG. 6.

Also, in this example, the length $W_{53}$ of the groove portion 53 is more than two times and three times or less the width $W_7$ of the attachment portion 71 of the pushing member 7. A position at which the attachment portion 71 is arranged in the groove portion 53 in the long-side direction of the case 5 can be adjusted in a range of the length $W_{53}$. If $2\times W_7<W_{53}\leq 3\times W_7$ holds true, the degree of freedom to adjust the arrangement position of the attachment portion 71 is high.

In this example, even if the attachment portion 71 of the pushing member 7 is arranged on the left closed end 535 side shown in FIG. 6, the pushing member 7 is unlikely to come loose from the second groove portion 532. The reasons for this are that the second groove portion 532 and a portion of the attachment portion 71 are arranged to reliably overlap each other due to $(W_{53}-(W_{51}+W_{52}))<W_7<W_{52}$ holding true.

FIG. 6 shows a state in which, with regard to the attachment portion 71 of the pushing member 7 fitted to the second groove portion 532, a surface of the attachment portion 71 in the engaging portion located on the bottom portion 51 side, here, the lower surface thereof is in contact with the inner circumferential surface of the second groove portion 532. This arrangement state is an example. A configuration may be adopted in which the engaging portion of the attachment portion 71 is fitted to the second groove portion 532 and is in contact with only the second resin portion 62, and is not in contact with the inner circumferential surface of the second groove portion 532, for example. That is, the entire outer circumferential surface of the engaging portion of the attachment portion 71 may be covered by the second resin portion 62.

The number, shape, size, and the like of groove portions 53 can be changed as appropriate. The number of groove portions 53 may be one for one pushing member 7, for example. In this case, one end of the pushing member 7 may be fitted to the groove portion 53, and the other end of the pushing member 7 may be pushed against and fixed to the inner surface 521 of the case 5, for example. However, as in this example, a structure in which both end portions of the pushing member 7 are fitted to the groove portions 54 and 55 is preferable because vibration of the case 5 is unlikely to be transmitted to the pushing member 7. Changing of the shape of the groove portion 53 preferably refers to Variation 2 that will be described later.

Sealing Resin Portion

Hereinafter, the sealing resin portion 6 will be described in detail with mainly referring to FIGS. 6 and 7.

The sealing resin portion 6 includes a first resin portion 61 (FIG. 7) and a second resin portion 62 (FIG. 6). A portion in the case 5 located between the assembly 10 and the main body portion 70 of the pushing member 7 is filled with the first resin portion 61. The groove portion 53 provided in the side wall portion 52 of the case 5 is filled with the second resin portion 62. At least a portion of the attachment portion 71 of the pushing member 7 is embedded in the second resin portion 62.

In this example, the first resin portion 61 is provided between a surface of the assembly 10 that is arranged on the opening side of the case 5, here, the upper end surface 330 of the outer core portion 33, and the back surface 702 of the main body portion 70. The pushing member 7 is not in contact with the assembly 10 because the first resin portion 61 is interposed therebetween. Thus, when the assembly 10 is vibrating, vibration of the assembly 10 is not directly transmitted to the pushing member 7. In this respect, the pushing member 7 readily inhibits displacement of the sealing resin portion 6 when the sealing resin portion 6 vibrates following vibration of the assembly 10. Also, in this example, the first resin portion 61 is in contact with the surface of the main body portion 70 located on the bottom portion 51 side of the case 5, here, the back surface 702. Here, if a gap is present between the first resin portion 61 and the back surface 702, when the sealing resin portion 6 vibrates, the first resin portion 61 is displaced in the above-described range of the gap. If the first resin portion 61 is displaced so as to come into contact with the back surface 702, further displacement is inhibited due to the pushing member 7. In contrast, the first resin portion 61 is preferably in contact with the back surface 702 in a state in which the sealing resin portion 6 is not vibrating because the pushing member 7 can reliably inhibit displacement of the first resin portion 61.

It is preferable to adjust the thickness $t_6$ of the first resin portion 61 such that, qualitatively, the assembly 10 and the pushing member 7 are not in contact with each other, and stress and strain caused by the displacement of the sealing resin portion 6 are reduced. The thickness $t_6$ is more than or equal to the minimum thickness of a portion of the sealing resin portion 6 with which a portion located between the outer circumferential surface of the assembly 10 and the inner surface 521 of the side wall portion 52 is filled, and is less than or equal to the thickness $t_7$ of the pushing member 7, for example, depending on the constituent material of the sealing resin portion 6, the constituent material, the size, and the like of the pushing member 7 though.

The second resin portion 62 need only cover at least the surrounding portion of the attachment portion 71 of the pushing member 7 in the groove portion 53. In this example, the entire portion of the second groove portion 532 other than the portion where the attachment portion 71 is in contact with the inner circumferential surface of the second groove portion 532 need only be filled with the sealing resin portion 6. A portion of the groove portion 53, here, a region of the first groove portion 531 located on the opening end 530 side, is not necessarily filled with the sealing resin portion 6. Note that the entire groove portion 53 may be filled with the sealing resin portion 6.

The sealing resin portion 6 need only be in contact with the back surface 702 of the main body portion 70 of the pushing member 7, or at least a portion of the main body portion 70 may be embedded therein. A state in which the pushing member 7 is arranged in the case 5 can be easily maintained due to the main body portion 70 being embedded in the sealing resin portion 6. In this example, a portion of the main body portion 70 is embedded in the sealing resin portion 6 (FIG. 7). However, a surface of the main body portion 70 that is located opposite to the bottom portion 51 of the case 5, here, the front surface 701, is exposed from the sealing resin portion 6. Also, in this example, the front surface 701 of the main body portion 70 is substantially flush with the end surface 520 of the side wall portion 52 of the case 5, and does not protrude from the end surface 520. That is, the height of the case 5 is substantially equal to the total thickness of the thickness $t_7$ of the main body portion 70, the thickness $t_6$ of the first resin portion 61, the length of the assembly 10 accommodated in the case 5 that extends in the depth direction of the case 5, and the thickness of the bottom portion 51.

Method for Manufacturing Reactor

The reactor 1 of this embodiment can be manufactured using a method for manufacturing a reactor that includes the following steps, for example.

First step: the assembly 10, the case 5, and the pushing member 7 are prepared.

Second step: the assembly 10 is accommodated in the case 5.

Third step: the pushing member 7 is arranged on the case 5.

Fourth step: the sealing resin portion 6 is formed in the case 5.

In the first step, the assembly 10 can be obtained by assembling the coil 2 and the magnetic core 3, and the holding member 4 as appropriate. If the assembly 10 includes a resin molded portion, a resin molded portion is formed. At least a portion of the assembly 10 is covered by unsolidified resin, which is the raw material of the resin molded portion, in a state in which the coil 2 and the magnetic core 3 are positioned by the holding member 4, and the resin is solidified, for example. The resin may cover at least a portion of the outer circumferential surface of the magnetic core 3 and not cover the coil 2, or may cover the coil 2 and the magnetic core 3.

In the second step, the assembly 10 is accommodated in the case 5 to realize a predetermined state in which the assembly 10 is accommodated. A predetermined gap is provided between the outer circumferential surface of the assembly 10 accommodated in the case 5 and the inner surface 521 of the side wall portion 52.

In the third step, the attachment portion 71 of the pushing member 7 is fitted to the groove portion 53 of the case 5. The attachment portion 71 is inserted from the opening end 530 of the groove portion 53, and is slid in the extending direction of the groove portion 53. In this example, the attachment portion 71 is slid in two directions in the extending direction of the groove portion 53.

Specifically, as virtually shown with use of line-double dashed lines in FIG. 8, the pushing member 7 is arranged on the case 5 such that the front surface 701 of the main body portion 70 of the pushing member 7 faces a side of the case 5 that is located opposite to the bottom portion 51 of the case 5, that is, the front surface 701 faces the opening side. In this state, the attachment portions 74 and 75 of the pushing member 7 are respectively inserted into the opening ends 530 of the end surface 520 of the side wall portion 52 in the groove portions 54 and 55 provided in the inner surfaces 522 and 523 of the side wall portion 52 of the case 5. White arrows shown in FIG. 8 indicate directions in which the pushing member 7 moves.

Then, the attachment portions 74 and 75 are slid in the extending direction of the first groove portions 531 of the groove portions 54 and 55, that is, in the depth direction of the case 5, toward the bottom portion 51 side of the case 5. At this time, the back surface 702 of the main body portion 70 is arranged facing a surface of the assembly 10 that is located opposite to the bottom portion 51, here, mainly the upper end surface 330 of the outer core portion 33.

After the attachment portions 74 and 75 pass through the first groove portions 531 of the groove portions 54 and 55, the attachment portions 74 and 75 are slid in the extending direction of the second groove portions 532, here, in the long-side direction of the case 5, toward the closed end 535. FIG. 8 virtually shows, with use of line-double dashed lines, the pushing member 7 that is in a state immediately before the pushing member 7 moves from the first groove portion 531 to the second groove portion 532. The arrangement positions of the attachment portions 74 and 75 in the second groove portions 532 of the groove portions 54 and 55 are preferably adjusted as appropriate.

In this example, with regard to two pushing members 7, as shown in FIG. 2, the attachment portions 71 are slid toward adjacent closed ends 535 in two groove portions 53 that are adjacent to each other in the long-side direction of the case 5. White arrows shown in FIG. 2 indicate directions in which the pushing members 7 move.

As shown in FIG. 8 with use of solid lines, due to the above-described sliding operation, the main body portion 70 of the pushing member 7 is arranged overlapping a surface of the assembly 10 that is located opposite to the bottom portion 51 side, here, the upper end surface 330 of the outer core portion 33. A predetermined gap is provided between the upper end surface 330 of the assembly 10 and the back surface 702 of the main body portion 70 in this arrangement state. The attachment portions 74 and 75 of the pushing members 7 are respectively fitted to the groove portions 54 and 55.

Typically, the attachment portions 74 and 75 of the pushing members 7 are in contact with surfaces of the inner circumferential surfaces of the second groove portions 532 located on the bottom portion 51 side of the case 5, namely, the lower surfaces thereof in FIG. 5. The pushing members 7 are supported to the groove portions 54 and 55 through contact between the attachment portions 74 and 75 and the second groove portions 532. Gaps are provided in the surrounding portions of the attachment portions 74 and 75 in the second groove portions 532, except for the above-described contact portions.

In this example, two pushing members 7 are arranged away from each other, for one assembly 10 (FIG. 1). Specifically, the pushing members 7 are respectively arranged on both sides of the upper end surface 330 of the outer core portion 33 in the longitudinal direction. Also, in this example, an intersection point of a short axis and a long axis of the main body portion 70 and the vicinity thereof are located on the bisector of the short side of the case 5 and the vicinity thereof.

In the fourth step, the case 5 in which the assembly 10 is accommodated and the pushing members 7 are arranged is filled with unsolidified resin that is the raw material of the sealing resin portion 6. An opening portion of an introduction tube may be arranged on the bottom portion 51 side of the case 5, and the case 5 may be filled with the resin with use of the introduction tube, for example. In this case, a liquid level of the resin moves upward from the bottom portion 51 side to the opening side of the case 5. Also, the above-described gap provided in the surrounding portion of the assembly 10 is filled with the resin, following the upward movement of the liquid level. Also, the resin covers the surface of the assembly 10 that is located opposite to the bottom portion 51, here, mainly, the upper end surface 330 of the outer core portion 33. As a result, the outer circumferential surface of the assembly 10 is covered by the resin.

The above-described gap provided between the upper end surface 330 of the assembly 10 and the main body portions 70 of the pushing members 7 is filled with the resin, and the resin comes into contact with the back surfaces 702 of the main body portions 70. The resin is solidified to constitute the first resin portion 61. Also, the groove portions 53 in which the attachment portions 71 of the pushing members 7 are arranged are filled with the resin. The resin is solidified to constitute the second resin portions 62.

Note that the arrangement positions of the attachment portions 71 of the pushing members 7 in the groove portions 53 may change as a result of the above-described liquid level of the rein moving upward. The above-described change is allowed as long as the attachment portions 71 are arranged in the groove portions 53, in particular, in the second groove portions 532 in this example.

When the above-described liquid level of the resin reaches a predetermined position, the filling operation is stopped to solidify the resin. The assembly 10 is embedded in the solidified sealing resin portion 6. At least portions of the attachment portions 71 of the pushing members 7 are embedded in the sealing resin portion 6 together with the groove portions 53. In this example, portions of the main body portions 70 are also embedded in the sealing resin portion 6, and the front surfaces 701 of the main body portions 70 are exposed from the sealing resin portion 6 (FIG. 7). The pushing members 7 are positioned with respect to the groove portions 53 by the sealing resin portion 6 with which the groove portions 53 are filled.

Applications

The reactor 1 of Embodiment 1 can be utilized in a component of a circuit for performing a voltage increasing operation and a voltage reducing operation. The reactor 1 can be utilized in constituent components of various converters, power conversion devices, and the like, for example. Examples of the converter include in-vehicle converters and air-conditioner converters. A typical example of the in-vehicle converter is a DC-DC converter. Examples of a vehicle provided with a converter include hybrid automobiles, plug-in hybrid automobiles, electric automobiles, and fuel cell automobiles.

Main Effects

The reactor 1 of Embodiment 1 is capable of, due to the pushing members 7 arranged in contact with the first resin portion 61, inhibiting displacement of the sealing resin portion 7 caused by vibration and the like, here, mainly the displacement thereof in the depth direction of the case 5.

In particular, the pushing members 7 are not directly fixed to the case 5 through bolt fastening, pressure fitting, or the like in the reactor 1. Thus, the contact area of the pushing members 7 with the case 5 is smaller than that of a structure in which a pushing member is directly fixed to a case through bolt fastening, pressure fitting, a plate spring, or the like. As a result, vibration of the case 5 is unlikely to be transmitted to the pushing members 7 when the case 5 is vibrating. Thus, the pushing members 7 are unlikely to vibrate together with the case 5.

Also, the pushing members 7 are not in direct contact with the assembly 10 due to the first resin portion 61 of the sealing resin portion 6. In other words, the pushing members 7 indirectly fixes the assembly 10. Thus, the pushing members 7 are also unlikely to be influenced by vibration of the assembly 10.

Also, the second resin portion 62 of the sealing resin portion 6 keeps the pushing members 7 fitted to the groove portions 53.

From these points, the state in which the main body portions 70 of the pushing members 7 are arranged overlapping the assembly 10 can be easily maintained. Such a reactor 1 is capable of more reliably inhibiting the above-described displacement of the sealing resin portion 6 due to the pushing members 7.

The reactor 1 of this example can readily inhibit the above-described displacement of the sealing resin portion 6 also because the main body portions 70 of the pushing members 7 have a planar shape with high rigidity.

Thus, in the reactor 1 of Embodiment 1, the sealing resin portion 6 favorably functions as a member for fixing the assembly 10 into the case 5, such as a heat dissipation path of the assembly 10, for a long period of time. Such a reactor 1 can improve the reliability of the structure for fixing the assembly 10 and has high heat dissipation properties even if resin constituting the sealing resin portion 6 is a resin having relatively low elastic modulus, for example, a silicone resin or the like.

Also, in the reactor 1 of this example, the pushing members 7 are less likely to come loose from the groove portions 53, and the sealing resin portion 6 can be readily held by the case 5 because of the following four points. Thus, with the reactor 1, the assembly 10 is less likely to come off from the case 5.

- One pushing member 7 includes a plurality of attachment portions 74 and 75, the case 5 includes a plurality of groove portions 54 and 55, and the attachment portions 74 and 75 are fitted to the groove portions 54 and 55. Accordingly, the pushing members 7 are less likely to come loose from the groove portions 54 and 55, compared to a case where one groove portion 53 is provided for one pushing member 7. Also, if the number of groove portions 53 is large, the number of portions of the sealing resin portion 6 that are caught in the groove portions 53 is large.
- The groove portion 53 is constituted by a plurality of grooves having different extending directions. The attachment portion 71 of the pushing member 7 fitted to the closed end 535 side of such a groove portion 53 is less likely to be displaced toward the opening end 530 side, compared to a case where the groove portion 53 extends in one direction, such as a case where the groove portion 53 is a linear groove extending in the above-described depth direction, for example. Also, a region of the second resin portion 62 that is caught in the groove portion 53 is more likely to be large, compared to a case where the groove portion 53 extends in one direction, that is, the groove portion 53 has an I-shape.
- The extending direction of the second groove portion 532 having the closed end 535 is orthogonal to the extending direction of the first groove portion 531 having the opening end 530. The attachment portion 71 located on the closed end 535 side of such a groove portion 53 is less likely to be displaced toward the opening end 530 side, compared to a case where the second groove portion 532 intersects therewith in a non-orthogonal manner. Also, the second resin portion 62 is more likely to be caught in the second groove portion 532, compared to a case where the second groove portion 532 intersects therewith in a non-orthogonal manner.
- The second resin portion 62 is caught in the second groove portion 532 of the groove portion 53 because the groove portion 53 has a T-shape, even if a force for pulling the sealing resin portion 6 that forms a single body with the assembly 10 toward the opening side of the case 5 is applied to the sealing resin portion 6. When the groove portion 53 has a T-shape, a region of the second resin portion 62 that is caught in the second groove portion 532 is larger than in a case where the groove portion 53 has an I-shape or an L-shape.

Also, the reactor 1 of Embodiment 1 is small because of the following three points.

- A base for bolt fastening, a space in which a plate spring is arranged, and the like are not required, and thus the size of the case 5 can be readily reduced.
- The pushing member 7 has a size that allows it to be accommodated in this case 5.
- In this example, the front surface 701 of the main body portion 70 of the pushing member 7 is exposed from the sealing resin portion 6, and the height of the case 5 can be further readily reduced.

The reactor 1 is light in weight because the height of the case 5 is small and the amount of the sealing resin portion 6 with which the case 5 is filled is small due to the front surface 701 of the main body portion 70 being exposed.

In addition, the reactor 1 of Embodiment 1 has high manufacturability because of the following six points.

- It is likely that the number of components is small, and the assembling time is short because bolt fastening is not required.
- The attachment portion 71 of the pushing member 7 can be easily fitted to the groove portion 53 by sliding the attachment portion 71 in the extending direction of the groove portion 53. In particular, with the reactor 1 of this example, the first groove portion 531 having the opening end 530 extends in the depth direction of the case 5. Thus, the attachment portion 71 of the pushing member 7 can be easily slid from the opening end 530 toward the bottom portion 51 side of the first groove portion 531. The second groove portion 532 extends in a direction orthogonal to the extending direction of the first groove portion 531. Thus, the attachment portion 71 can be easily slid from the first groove portion 531 toward the closed end 535 side of the second groove portion 532.
- The main body portion 70 of the pushing member 7 is smaller than the opening portion of the case 5, and can be readily accommodated in the case 5.
- The width $W_7$ of the attachment portion 71 of the pushing member 7 is smaller than that of the main body portion 70, and thus the attachment portion 71 can be readily fitted to the groove portion 53.

As described above, in this example, the filling time and the solidification time can be shortened because the amount of the sealing resin portion 6 with which the case is filled is small. It is also expected that manufacturing costs can be reduced.

Because the groove portion 53 has a T-shape, a cutting process for forming a groove can be more easily performed, compared to a case where the groove portion 53 has an L-shape, for example.

Test Example 1

Vibration properties of sealing resin portions were evaluated with regard to reactors that included pushing members and reactors that did not include pushing members.

Reactors to be evaluated had the same configuration as the reactor 1 of Embodiment 1, except for the presence or absence of the pushing member. That is, each of the reactors included an assembly having a coil and a magnetic core, a case, and a sealing resin portion (FIG. 1 and the like). A reactor of Sample No. 1 further included two pushing members. A reactor of Sample No. 100 did not include a pushing member.

Vibration properties were evaluated through CAE (Computer Aided Engineering) analyses with use of structural analysis software. The structural analysis software uses NX NASTRAN to perform frequency response analyses. When a sealing resin portion vibrates due to the resonance frequency with an assembly, the amount of displacement of the sealing resin portion in the depth direction of the case is analyzed.

As a result of analyses, with the reactor of Sample No. 100, a portion of the sealing resin portion located on the opening side of the case, that is, substantially the entire portion of the assembly that covers a surface that is located opposite to the bottom portion of the case vibrated, and thus the amplitude was high. In particular, out of the above-described portion located on the opening side, an intersection point of a bisector of a long side of the case and a bisector of a short side of the case, and the vicinity thereof expand greatly toward the opening side. Thus, with the reactor of Sample No. 100, stress and strain caused by a large displacement are likely to be applied to the sealing resin portion. There is a concern that the sealing resin portion will undergo cohesive failure and separate from the case due to the above-described stress and strain.

In contrast, with the reactor of Sample No. 1, the displacement of a portion of the sealing resin portion located on the opening side of the case is smaller than that of Sample No. 100. Here, the maximum amplitude of Sample No. 1 was about 60% based on the maximum amplitude of Sample No. 100. That is, the maximum amplitude of Sample No. 1 was reduced by about 40%. Based on this, it can be said that the pushing member is capable of inhibiting the displacement of the sealing resin portion. Also, with Sample No. 1, the resonance frequency of the sealing resin portion with the assembly was larger than that of Sample No. 100, and moved to a high frequency side. Here, the resonance frequency of Sample No. 1 was higher by about 15% based on the resonance frequency of Sample No. 100. Based on this, it can be said that the pushing member contributed to increasing the above-described resonance frequency in the sealing resin portion.

The present disclosure is not limited to these examples, but is indicated by the scope of the claims, and all changes that come within the meaning and range of equivalency of the claims are intended to be embraced therein.

At least one of the following modifications to the above-described reactor 1 of Embodiment 1 is possible, for example.

Variation 1: The number of pushing members 7 is one.

In this case, the arrangement position of the pushing member 7 with respect to the case 5 need only be a position where the maximum amplitude may occur when the sealing resin portion 6 vibrates. The groove portions 53 may be arranged in the central portion of the case 5 in the long-side direction shown in FIG. 1, for example.

Alternatively, the pushing members 7 may be arranged on the case 5 shown in FIG. 1 in the long-side direction of the case 5, instead of the short-side direction of the case 5, for example. In this case, the groove portions 53 and 54 are provided in the inner surfaces 524 and 525.

Variation 2: The shape of the groove portion 53 is any one of the following (1) to (4).

(1) The groove portion 53 is a linear groove that extends from the opening end 530 to the closed end 535 in the depth direction of the case 5.

(2) The groove portion 53 is a linear groove that extends from the opening end 530 to the closed end 535 in a direction that intersects with the depth direction of the case 5 in a non-orthogonal manner. In other words, the groove portion 53 is an inclined groove.

(3) The extending direction of the first groove portion 531 in the groove portion 53 is the depth direction of the case 5, and the groove portion 53 is a linear groove in which the extending direction of the second groove portion 532 extends in a direction intersecting with the above-described depth direction in a non-orthogonal manner. In other words, the crossing angle between the first groove portion 531 and the second groove portion 532 is not a right angle, but an obtuse angle or an acute angle.

(4) The extending direction of the first groove portion 531 in the groove portion 53 is the depth direction of the case 5, and the groove portion 53 is a linear groove in which the extending direction of the second groove portion 532 extends in a direction orthogonal to the above-described depth direction.

Variation 3: The state in which the assembly 10 is accommodated in the case is (1) or (2) below.

(1) In a state in which the assembly 10 is accommodated in the case 5, axial directions of the winding portions 21 and 22 are orthogonal to the depth direction of the case 5, and the axes of the winding portions 21 and 22 are arranged at the same position in the depth direction. This accommodating state is the accommodating state disclosed in JP 2016-207701A. In this accommodating state, a surface of the assembly 10 that is located opposite to the bottom portion 51 of the case 5 includes a portion of the outer circumferential surfaces of the two winding portions 21 and 22 and a portion of the outer circumferential surfaces of the two outer core portions 33.

(2) In a state in which the assembly 10 is accommodated in the case 5, the axial directions of the winding portions 21 and 22 are orthogonal to the depth direction of the case 5, and the axes of the winding portions 21 and 22 are arranged side-by-side in the depth direction. In this accommodating state, a surface of the assembly 10 that is located opposite to the bottom portion 51 of the case 5 includes a portion of the outer circumferential surface of one winding portion 21 and a portion of the outer circumferential surfaces of the two outer core portions 33.

Variation 4: The coil 2 satisfies at least one of the following configurations (1) to (5).

(1) The winding portions 21 and 22 are respectively constituted by different winding wires.

In this case, the linking portion 23 may have a configuration in which end portions of the winding wires to which no external apparatuses are connected are directly connected to each other through welding, crimping, or the like, or may have a configuration in which these end portions are indirectly connected to each other using a fitting.

(2) A winding wire may be a wire material other than a coated flat wire, examples thereof including a coated round wire whose cross-sectional shape is circular.

(3) The shapes of the winding portions 21 and 22 may be a shape other than a rectangular tubular shape, and an example thereof includes a tubular shape.

(4) The winding portions 21 and 22 have different specifications.

(5) The number of winding portions is one.

Variation 5: The magnetic core 3 satisfies at least one of the following configurations (1) to (4).

(1) The number of core pieces constituting the magnetic core 3 is one, two, three, five, or more.

(2) The magnetic core 3 includes a core piece that has a portion arranged in a winding portion of the coil 2, and a portion arranged outside the winding portion. Examples of such a core piece include a U-shaped core piece, an L-shaped core piece, and an E-shaped core piece.

(3) A configuration may be adopted in which at least one of the inner core portions 31 and 32 is not a single core piece, and is constituted by a plurality of core pieces. In this case, a magnetic gap may be present between adjacent core pieces.

(4) The outer circumferential shapes of the inner core portions 31 and 32 are not similar to the inner circumferential shape of the winding portions 21 and 22. A configuration may be adopted in which the winding portion 21 has a rectangular tubular shape, and the inner core portion 31 has a round columnar shape.

Variation 6: The reactor 1 includes an adhesive layer (not shown) between the assembly 10 and the inner bottom surface of the bottom portion 51 of the case 5.

What is claimed is:

1. A reactor comprising:

an assembly that includes a coil and a magnetic core;

a case in which the assembly is accommodated;

a sealing resin with which the case is filled; and a pushing plate accommodated in the case, wherein the case includes a bottom, a side wall, and at least one groove that is open in an inner surface of the side wall, the groove of the case includes an opening end provided in an end surface of the side wall of the case that is located opposite to the bottom of the case, and a closed end provided on the bottom of the case with respect to the opening end, the pushing plate includes a main body and at least one attachment that extends from the main body, the main body is arranged overlapping a surface of the assembly that is located opposite to the bottom of the case, the attachment is fitted to the groove of the case, the sealing resin includes a first resin with which a portion located between the assembly and the main body is filled, and a second resin with which the groove of the case is filled.

2. The reactor according to claim 1, wherein the groove of the case includes two grooves, the attachment of the pushing plate includes two attachments on respective sides of the main body, the two grooves of the case are respectively provided in opposing portions of the inner surface, and the two attachments are respectively fitted to the two grooves of the case.

3. The reactor according to claim 1, wherein the groove of the case includes a first groove and a second groove that is continuous with the first groove, the first groove has the opening end, the second groove has the closed end, and an extending direction of the first groove and an extending direction of the second groove are different from each other.

4. The reactor according to claim 3, wherein the extending direction of the first groove is a depth direction of the case, and the extending direction of the second groove is a direction orthogonal to the depth direction.

5. The reactor according to claim 1, wherein a surface of the main body that is located opposite to the bottom of the case is exposed from the sealing resin.

6. The reactor according to claim 1, wherein a planar shape of the main body is a rhombus shape.

* * * * *